US008221182B2

(12) United States Patent
Seymour et al.

(10) Patent No.: US 8,221,182 B2
(45) Date of Patent: Jul. 17, 2012

(54) THREE-DIMENSIONAL STRUCTURES WITH ELECTRONIC CIRCUIT PATHS AND SAFETY CIRCUITS

(75) Inventors: Arthur Seymour, Wheeling, IL (US); Brian P. Johnson, Wheeling, IL (US); Alexander B. Matz, Wheeling, IL (US); Marc C. Lehner, Wheeling, IL (US); Gerald J. Ceuhin, Wheeling, IL (US)

(73) Assignee: Elenco Electronics, Inc.

( * ) Notice: Subject to any disclaimer, the term of this patent is extended or adjusted under 35 U.S.C. 154(b) by 266 days.

(21) Appl. No.: 12/639,327

(22) Filed: Dec. 16, 2009

(65) Prior Publication Data

US 2011/0143629 A1 Jun. 16, 2011

(51) Int. Cl.
*A63H 33/04* (2006.01)

(52) U.S. Cl. ..... 446/91; 446/85; 446/120; 446/122; 446/124

(58) Field of Classification Search ..... 446/119–122, 446/124–126, 85, 175, 484; 361/1, 93.1
See application file for complete search history.

(56) References Cited

U.S. PATENT DOCUMENTS

| | | | | | |
|---|---|---|---|---|---|
| 4,606,732 | A * | 8/1986 | Lyman | 446/120 |
| 5,645,463 | A * | 7/1997 | Olsen | 446/104 |
| 5,947,787 | A * | 9/1999 | Cyrus et al. | 446/127 |
| 5,984,756 | A * | 11/1999 | Krog | 446/120 |
| D420,710 | S * | 2/2000 | Poulsen | D21/486 |
| 6,030,270 | A * | 2/2000 | Krog | 446/102 |
| 6,443,796 | B1 * | 9/2002 | Shackelford | 446/91 |
| 6,585,553 | B1 * | 7/2003 | Fetridge et al. | 446/91 |
| 7,044,825 | B2 * | 5/2006 | Glickman et al. | 446/121 |
| 7,708,615 | B2 * | 5/2010 | Munch | 446/91 |
| 7,942,717 | B2 * | 5/2011 | Chou | 446/91 |
| 2002/0196250 | A1 * | 12/2002 | Anderson et al. | 345/420 |
| 2005/0243489 | A1 * | 11/2005 | Seymour | 361/93.1 |
| 2008/0166926 | A1 * | 7/2008 | Seymour et al. | 439/701 |
| 2010/0311300 | A1 * | 12/2010 | Hansen et al. | 446/91 |
| 2010/0330867 | A1 * | 12/2010 | Fogel et al. | 446/124 |
| 2011/0151743 | A1 * | 6/2011 | Munch et al. | 446/91 |

* cited by examiner

*Primary Examiner* — Dmitry Suhol
*Assistant Examiner* — Alex F. R. P. Rada, II
(74) *Attorney, Agent, or Firm* — Justin Lampel

(57) ABSTRACT

A three-dimensional electro-mechanical system for making mechanical structures using snap-together parts or building blocks that easily demonstrate the principles required in making three-dimensional electronic circuits incorporated in the mechanical structures. A reusable electronic module that contains batteries or other power sources and has means for attaching to other electronic modules to power these three-dimensional circuits and prevent and warn the user of excessive current.

17 Claims, 5 Drawing Sheets

THREE-DIMENSIONAL STRUCTURES WITH ELECTRONIC CIRCUIT PATHS AND SAFETY CIRCUITS

FIELD OF THE INVENTION

A three-dimensional electro-mechanical system having mechanical structures that produce electrical circuits as an integral part of the mechanical structure is provided. The electro-mechanical system relates specifically to mechanical structures that easily and quickly connect together. The system has safety circuits in communication with the power supply, which make the system especially suitable for use by children and/or students while learning electronics, mechanics, and/or architecture.

BACKGROUND OF THE INVENTION

Toys and teaching aids exist that use mechanical connectors to quickly assemble electronic circuits. Further, toys and teaching aids exist that use a mechanical connector to quickly assemble mechanical structures. Some of these mechanical structures add a motor for motion or a light for visual effects. These toys are often used to amuse a child or teach some mechanical or electronic principle. Quick connect electronic assembly systems currently being sold usually consist of a box of electronic devices mounted to quick connect electronic modules. Diagrams for electronic circuits are included to educate a student or entertain a child. Most of these circuits are assembled in the same or parallel plane, and the circuit paths are not part of a three-dimensional mechanical structure such as a building, a Ferris wheel, or an airplane, to name just a few.

Examples of previous construction block patents include U.S. Pat. No. 6,443,796 to Shackelford, which provides a child's construction set containing virtual intelligence and is interactive and smart. These characteristics may be exhibited to a player during player construction activity with the set and, thereafter, during continuing play; this instills a sense of unpredictability to play. The set incorporates a programmed controller (17), a speaker (23), special ("smart") play pieces or blocks (1,3,5,7, et cet.), and a base (15) on which to position the play pieces or blocks. Sensors (A1-C3), referred to as "hot spots," are distributed at various positions about the base and are coupled to the controller, whereby the controller identifies special play pieces and the location of those play pieces when the respective play piece is installed at one of those positions. Some of the special play pieces may depict characters, some contain electrically operated devices, and some contain a player-operated input device. The controller issues speech messages or other audible effects through the speaker to effect a virtual personality to the character play pieces as well as controls operation of electrically operated devices in special blocks, and detects and responds to player inputs from the player input blocks. Through wireless communication devices, the controller may acquire information from and supply speech messages to accessory blocks that are used off the base of the construction set.

SUMMARY OF THE INVENTION

Most electronic circuits are created on a flat surface or base to keep components in close proximity, their connection paths short and to keep the electrical circuits in the same or parallel plane. The current system allows the assembly of electronic circuits and mechanical structures to exist in multiple planes and at distal locations to each other. Further, the present system helps eliminate circuit errors, which can be difficult to detect. More specifically, the circuit errors may be prevented by, for example, placing safety devices that protect and warn the user of electronic assembly errors in the connecting process. The system may also help eliminate shorted power sources during construction by keeping the assembly of these electro-mechanical structures quick, simple, and educational.

It is the purpose of this system to use both conductive and non-conductive quick connect or stackable parts that can form three-dimensional mechanical structures. The conductive parts may be used to form electronic paths through the mechanical structure, and the non-conductive parts may be used to insulate and prevent shorts to undesired areas. The system may have an additional power source module that makes an error in the electronic assembly obvious with any combination of sounds, lights, and/or speech.

DETAILED DESCRIPTION OF THE PREFERRED EMBODIMENT

Figure 1:
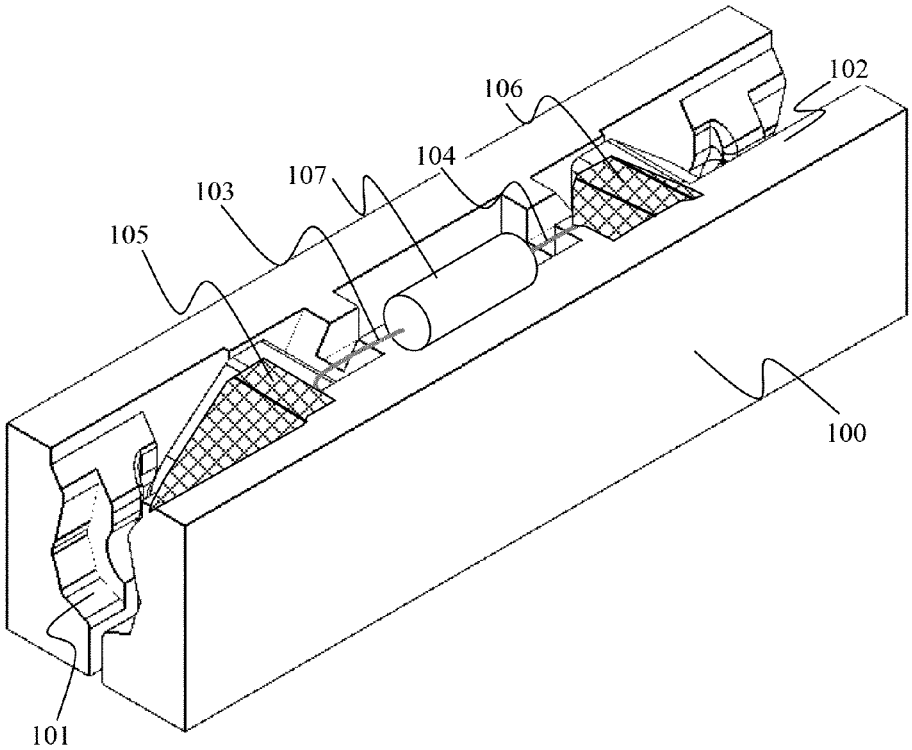
FIG. 1 illustrates a perspective view of an electronically non-conductive construction beam 100 with non-conductive female connectors 101, 102 containing a conductive clip 105, 106, which is mechanically and electronically connected to leads 103, 104 of an electronic component 107.
Figure 2:
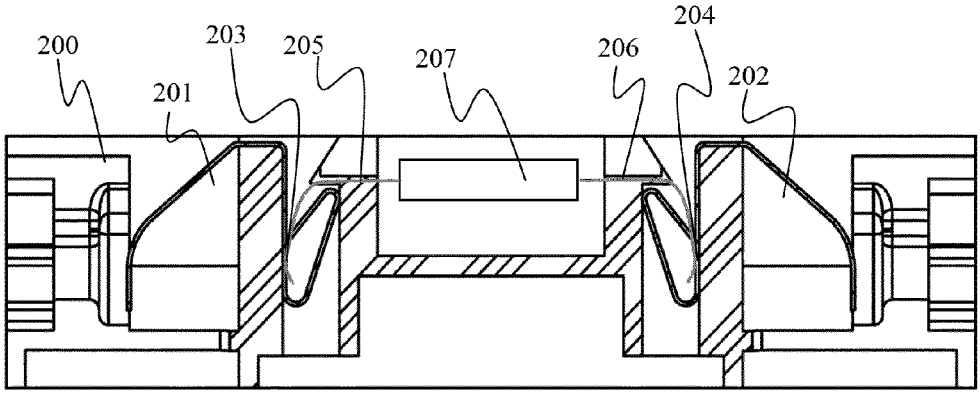
FIG. 2 is a side plan view having the right side wall removed of a non-conductive construction beam 200 showing the two conductive clips 201, 202 and the mechanical connections 203, 204 between the conductive clips 201, 202 and the leads 205, 206 of an electronic component 207.

The present system has a power-source module 500, 824 having warnings that may include, for example, audible sound and/or speech circuits 508 and/or a visual indicator 505, 605, 701, 823 when too much electrical current is being removed from the batteries 502-504, 600 to power consuming components of the system. The surfaces on the power-source module housing 500, 824 may be non-conductive so as to prevent the components from being shorted. A current limiting device 501, 601 may limit the flow of electrical current from the direct current (DC) batteries 502-504, 600 by dropping voltage across the body of the current limiting device 501, 601. The addition of a bi-color light-emitting diode (LED) 505, 604, 605, 701, 823 may glow, for example, green when power is on 604 and may turn, for example, red 605 when too much current is being drawn from the batteries 502-504 or may glow when a short between positive electrical paths 710, 719, 816 and negative electrical paths 717, 718, 809 exists. The speaker 507, 602, 708, 821 and circuit board 508, 606 may provide an audible tone and/or speech to indicate that an excessive current condition exists.

The system may have two non-conductive mechanical female connection areas 511, 512, which may provide positive voltage 608 output points through conductive springs or clips 513, which may connect to conductive male connecting 403 mechanical structures. In a similar manner, the non-conductive mechanical female connectors 509, 510 on the other end may provide negative voltage 609 output points through a second conductive spring or clip 514 located at the distal end of the device, to conductive male connecting 403 mechanical structures.

A simple slide switch 506, 607, 700, 822 may be used to turn the positive voltage output 608 conductive springs or clips 513 on or off. A current limiting device 601, 501 may limit the current from the DC power source 600 by dropping voltage across the body of the device 501, 601. The addition of light-emitting diode (LED) 605 may provide a visual indication that too much current is being drawn and/or that a short exists in the system, while the light-emitting diode 604 may provide a visual indication that operation of the system is normal and that the power source 500, 702, 824 is turned on.

A resistor 603 may limit the electrical current through the LEDs 505, 604, 605, 701, 823. In a similar manner, the addition of the circuit board 508, 606 may provide an audible tone through the speaker 507, 602, 708, 821 to indicate that an excessive current condition exists. The circuit board 508, 606 may receive no voltage across it when the current limiting device 501, 601 is in a mode to supply circuit current and not produce a voltage drop. When excessive current is drawn, the current limiting device 501, 601 may produce a voltage drop that may appear across the circuit board 508, 606. As a result, the voltage drop may produce a light through an LED 605, 505, and/or audible warning sounds through the speaker 507, 602, 708, 821.

Figure 3:
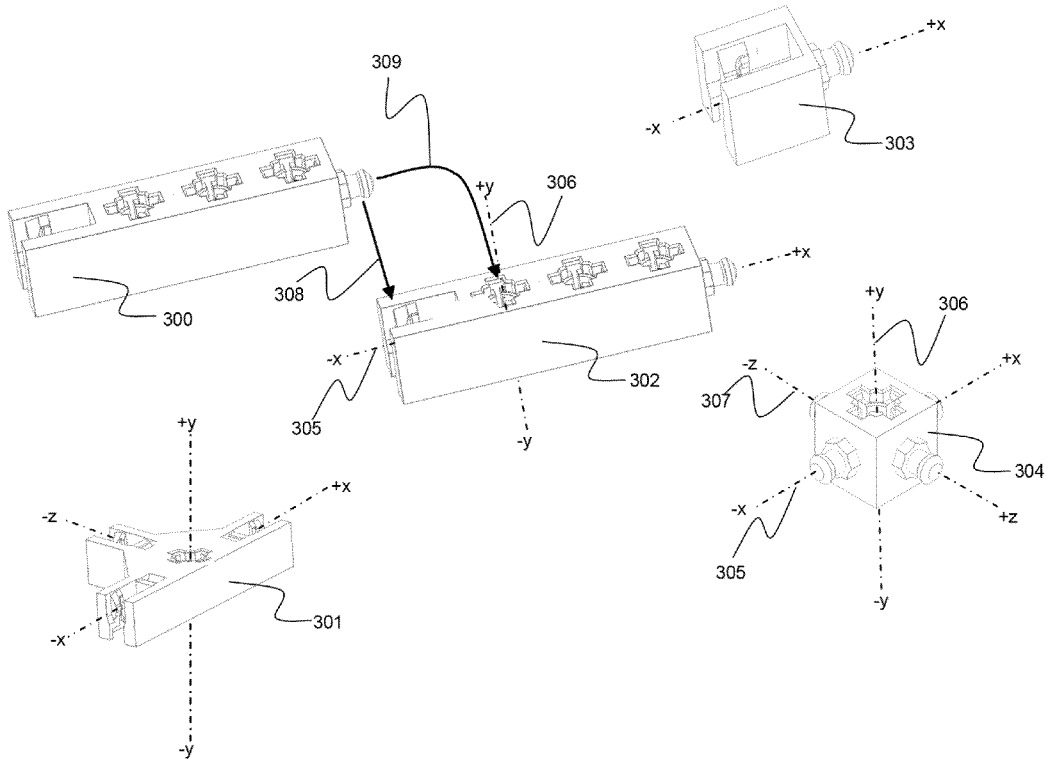
FIG. 3 illustrates conductive mechanical parts 300-304 with dashed lines indicating the x-axis 305, y-axis 306, or z-axis 307 along which current paths may exist.
Figure 4:
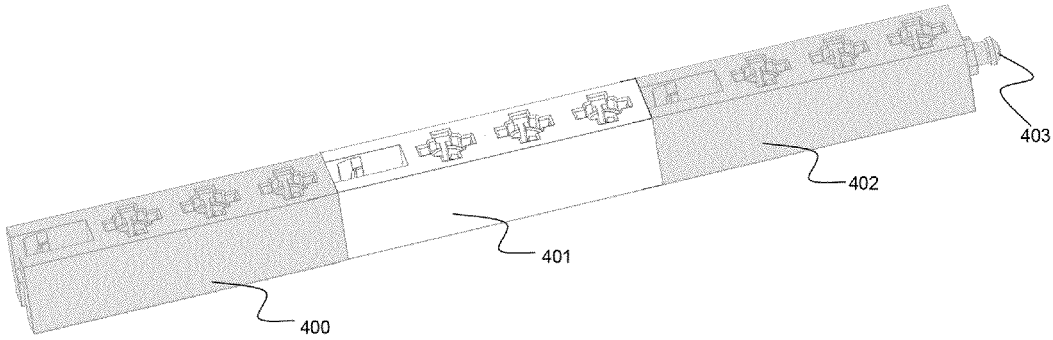
FIG. 4 illustrates a non-conductive mechanical part 401 with the same shape and size as shown in FIG. 3 that may be used to block current flow between conductive parts 400, 402.
Figure 5:
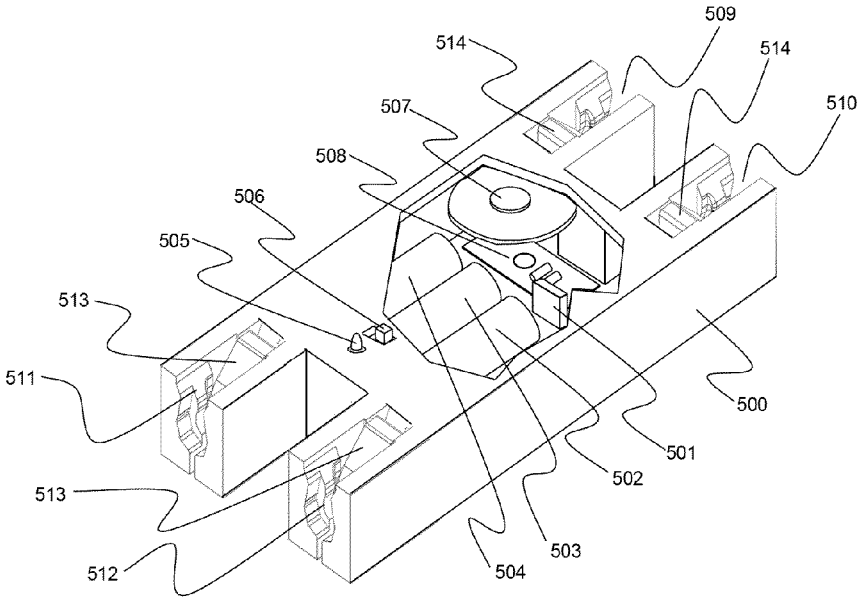
FIG. 5 illustrates a battery-powered voltage source module 500 with a Current limiting device 501, an audible tone and speech circuit 508, and a bi-color light-emitting diode (LED) 505 to indicate proper operation or excess current.
Figure 6:
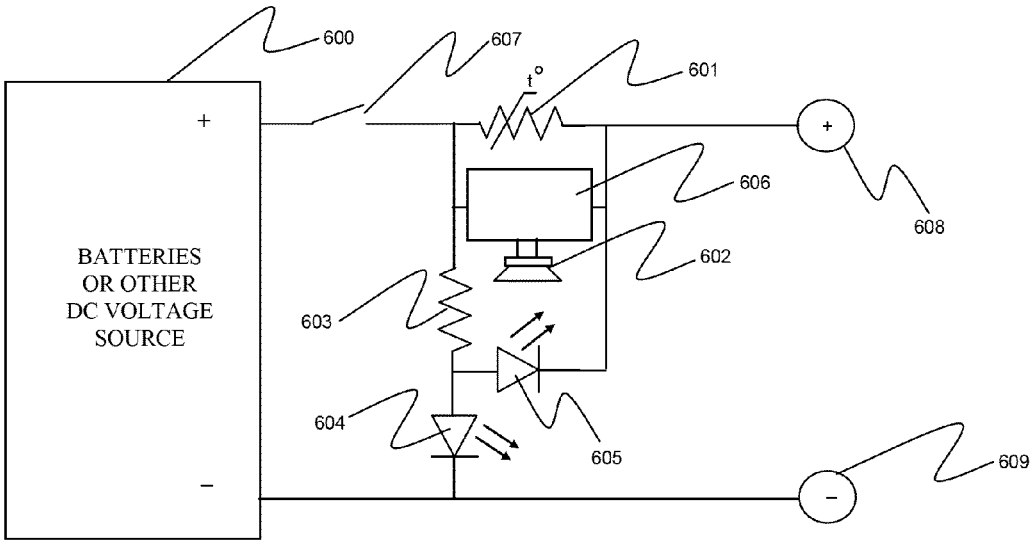
FIG. 6 illustrates the circuitry associated with the battery-powered voltage source module 500 that contains both visual and audible warning circuits 508.
Figure 7:
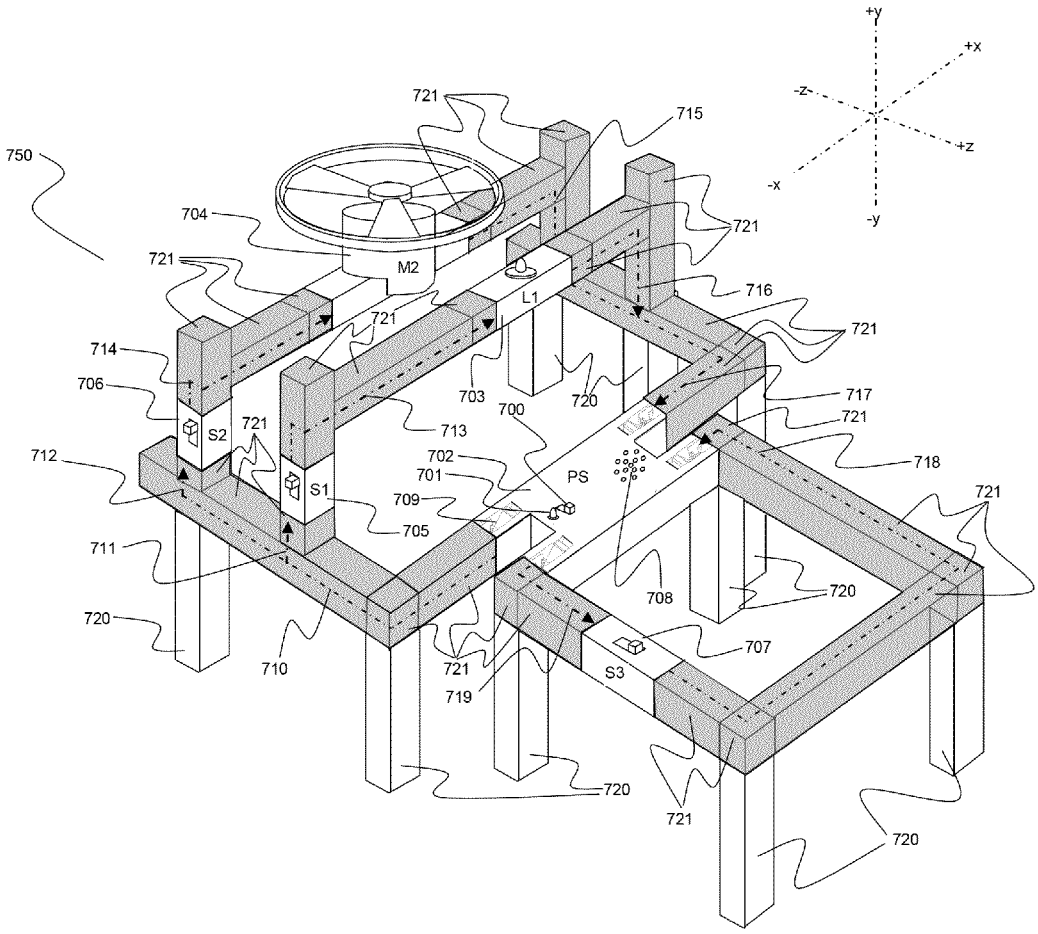
FIG. 7 illustrates an electro-mechanical 750 structure that uses beams to demonstrate the concept of mechanical structures with current paths 710-719, and conductive 721 and non-conductive parts 720 used in the mechanical structure.

A switch 506, 607, 700, 822 may be used to turn the voltage from the DC voltage source 502-504, 600 on or off. In this manner, a protected positive voltage may be made available at a plus terminal 608 of the power source 500, 824 with a return current path through the negative terminal 609, 820 of the power source 500, 824. The mechanical parts 300-304, 721, 801-808, 810-815 may be made of any conductive material or the surfaces of the mechanical parts 300-304, 721, 801-808, 810-815 may be plated so as to make all exposed surfaces electrically conductive. A conductive part 303 may only allow mechanical connection along one axis. Other parts 302 may only allow mechanical connection along two axes. Some parts 301,304 may allow mechanical connection along all three axes. When two conductive parts 300, 302 are connected along the same axis, as shown by the arrow 308 in FIG. 3, the electrical current will stay along the same x-axis 305. When two conductive parts 300, 302 are connected at right angles to each other, as shown by the arrow 309 in FIG. 3, the electrical current may change from the x-axis 305 to the y-axis 306. In this manner, electrical current can be directed in any direction along any axis. Non-conductive mechanical parts 401, 720, 825 with similar shapes and/or sizes as the parts shown in FIG. 3 and/or FIG. 8 may be used to block electrical current flow between conductive parts 300-304, 400, 402, 721, 801-808, 810-815 that may be part of the final mechanical structure being assembled. The non-conductive part 401, 720, 825 may be made from any material that does not conduct electrical current. The non-conductive part 401, 720, 825 may, however, be substantially identical mechanically to any conductive part 300-304, 400, 402, 721, 801-808, 810-815 used in the final mechanical structure. When a mechanical structure is built using the electro-mechanical parts described above, certain conductive paths 710-719, 809, 816 may also be created in the structure. Using conventional current techniques, it can be said that the electrical current path 710 may originate at the positive connector spring 513, 709 and may travel along the x-axis, then turn and travel along the z-axis. This electrical current 710 may split into two different currents, one 711 going in the +y axis toward switch S1 705, and the other 712 going in the +y axis toward switch S2 706. On the other side of switch S1 705, the current path 713 turns from the +y axis to the +x axis and goes to the light-emitting diode L1 703. After L1 703, the return current path 716 travels first along the +x axis then turns to travel along the −y axis. The current 716 is added to current 715 to produce the current 717, which travels along the +z axis and turns to the −x axis to terminate at the power source 702, 500.

In a similar fashion, current 714 may go through the motor M2 704 and may become current 715. Current path 719 leaves the power source along the −x axis and quickly turns to the +z axis to enter switch S3 707. The current 718 leaving switch S3 707 travels along the +z axis then turns and travels along the +x axis. This current 718 turns again on the −z axis and finally onto the −x axis to the negative end of the power source 702, 500. Since there may be no components to limit the amount of current flow in the current path 719 into switch S3 707, or in the current path 718 from S3 707 back to the power source 702, 500, the closing of switch S3 707 produces a short across the power source 702, 500. This excessive current is handled as previously described to warn the user and limit the current levels to a safe value.

Figure 8:
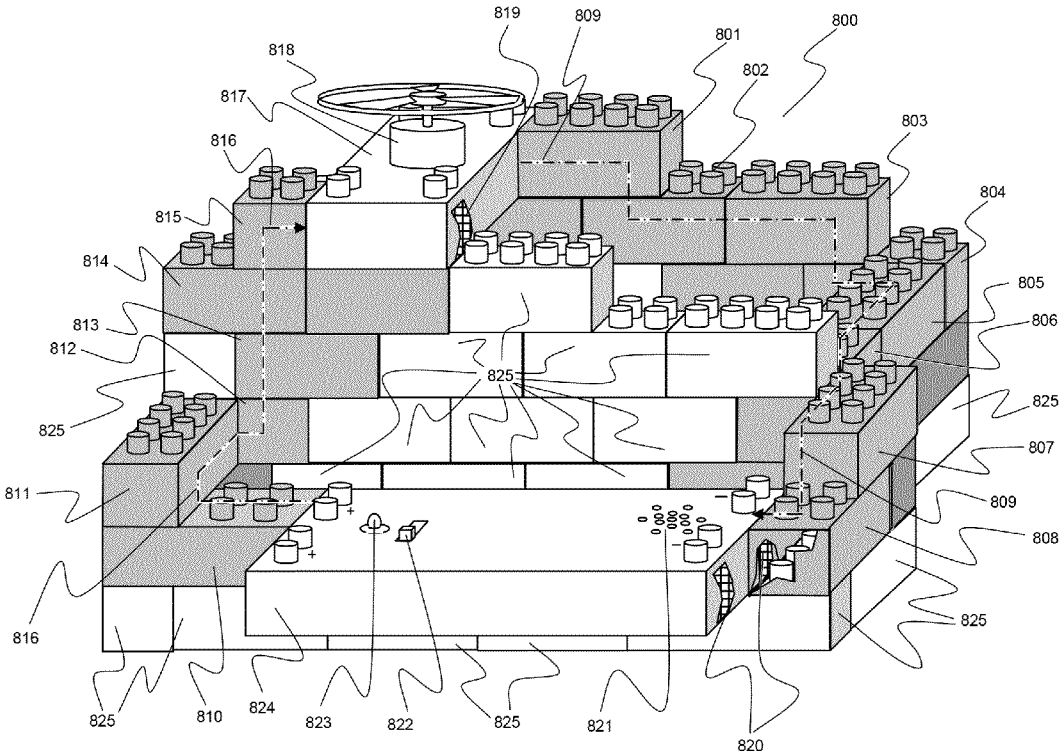
FIG. 8 illustrates an electro-mechanical 800 structure that uses blocks or bricks to demonstrate the concept of mechanical structures with current paths 809, 816 and conductive 801-808, 810-815 and non-conductive blocks or bricks 825 used in the mechanical structure.

When a mechanical structure is built using electro-mechanical parts, the shape of the parts may be blocks or bricks. Conductive paths 809, 816 may be created in the block or brick structure 800, as shown in FIG. 8. Using conventional current techniques, it may be said that the electrical current path 816 originates at the positive connector of the power source 824 and travels through conductive blocks 810-815 to arrive at the motor module 817. Block 815 makes contact to the motor 818 through a clip similar to the visible clip 819 shown on the other side of the motor module 817. Electrical current passes through the motor 818 and leaves the motor module 817 through current path 809 that originates at block 801. This current 809 travels through the conductive blocks 801-808 back to the negative side of the power source 824. Block 808 has a cutout view of the corner to show how the conductive block 808 makes contact to the spring or clip 820 on the power source 824. In this manner, the electrical current paths 809, 816 provide power to the motor 818 whenever the switch 822 turns on the power source 824. If the closing of the switch 822 produces excessive current for any reason, the overload on the power source 824 is handled as previously described to warn the user and limit the current levels to a safe value.

Although the mechanical structures 750, 800 have been shown using shapes similar to beams, blocks, or bricks, the structures are not limited to these shapes and could also have been rods, cylinders, star-shaped, L-shaped, and X-shaped, to name just a few. Accordingly, although the invention has been described by reference to a preferred embodiment, it is not intended that the novel electro-mechanical assembly be limited thereby, but that modifications thereof are intended to be included as falling within the broad scope and spirit of the forgoing disclosure, the following claims and the appended drawings.

What is claimed is:

1. A quick connect electro-mechanical system, comprising:

a plurality of interconnectable components having a housing wherein the housing has an interior and an exterior and wherein the interconnectable components have electrically conductive surfaces and non-electrically conductive surfaces and wherein a circuit is formed by electrically connecting at least two of the interconnectable components;

a snap-fitting mechanical connector system having a male and female component wherein the male snap-fitting mechanical connector extends outward from the interconnectable component and wherein the male snap-fitting mechanical connector has a shaft portion having a first end and a second end and wherein a head portion having a circumference greater than a circumference of the shaft portion is located at the first end and wherein the snap-fitting mechanical connector is located on a first end of the housing with non-electrically conductive surfaces but containing an electrical conductive element wherein the male snap-fitting mechanical connector connects a first interconnectable component to a second interconnectable component and wherein an opening in the female snap-fitting mechanical connector of the second component exposes an electrically conductive contact surface capable of forming a circuit with the male snap-fitting mechanical connector; and wherein the snap-fitting mechanical connector of the first interconnectable component allows the first interconnectable component to mechanically and electrically connect along an x-axis, a y-axis or z-axis with respect to the second interconnectable component wherein each of the axes is approximately ninety degrees with respect to each other.

2. The quick connect electro-mechanical system of claim 1 wherein said electronic conductive elements include at least one of the following: capacitors, resistors, diodes, light emitting diodes, display panels, inductors, transistors, semiconductors, power supplies, motors, fans, electronic sound emitters, speakers, buzzers, bells, alarms, microphones, light bulbs, strobe lights, switches, integrated circuits, computer chip, amplifiers, modulators, solar panels, computer interfaces, telephone interfaces, and combinations thereof.

3. The quick connect electro-mechanical system of claim 1 wherein said electrical conductive surfaces are: solid metal or other conductive material, conductive plastic, non-conductive plastic with plated conductive surfaces, any non-conductive material that is sprayed, plated, or otherwise treated to make the exposed surfaces conductive.

4. The quick connect electro-mechanical system of claim 1 wherein said non-conductive surfaces comprises a material selected from the group of: plastic, wood, paperboard, cardboard, glass, rubber, and any conductive material otherwise treated to make the exposed surfaces non-conductive.

5. The quick connect electro-mechanical system of claim 1 wherein said opening of the snap-fitting non-electrical mechanical connector exposes an electrical contact surface of: spring steel, stainless steel, phosphor bronze, or beryllium copper.

6. The quick connect electro-mechanical system of claim 1 wherein at least one of the plurality of interconnectable components has a power source that contains a current limiting device.

7. The quick connect electro-mechanical system of claim 6 wherein said current limiting device comprises a time delayed current limiter with visual and/or audible warnings.

8. The quick connect electro-mechanical system of claim 6 wherein said current limiting device comprises a positive temperature coefficient PTC resettable fuse that produces voltage used to produce a visual and/or audible warning when overload exist and automatically removes that voltage when the overload condition is removed.

9. The quick connect electro-mechanical system of claim 8 wherein said audible warning is speech in one or more languages.

10. The quick connect electro-mechanical system of claim 6 wherein the warning is removed when current is restored to a safe level.

11. The quick connect electro-mechanical system of claim 6 wherein said warning is one of or combination of, speech in one or more languages, a warning sound, a flashing light, a buzzer, or a vibration.

12. The quick connect electro-mechanical system of claim 6 wherein said current limiting device comprises a positive temperature coefficient PTC resettable fuse that produces a voltage used to produce a visual and audible warning when overload exist and automatically removes that voltage when the overload condition is removed.

13. The quick connect electro-mechanical system of claim 6 wherein said current limiting device comprises an electronic circuit that produces a voltage used to produce a visual and audible warning when overload exist and automatically removes that voltage when the overload condition is removed.

14. The quick connect electro-mechanical system of claim 1 wherein the first interconnectable component or second interconnectable component has an exterior surface which is entirely conductive and wherein the exterior surface acts to provide an electrical connection to another interconnectable component and wherein the exterior surface of the first interconnectable component or second interconnectable component further acts as a structural support forming a larger mechanical structure.

15. A quick connect electro-mechanical system, comprising:

a plurality of interconnectable components having an exterior surface wherein all exposed exterior surfaces of a first interconnectable component are electrically conductive and wherein the first interconnectable component lacks an interior circuit and wherein the exterior surface of the first component acts as the electrical connection within the electro-mechanical system;

a second interconnectable component having a housing with a substantially non-conductive exterior surface wherein the second interconnectabe component has an interior having an electrically conductive element passing through the same wherein the electrically conductive element is partially exposed on the exterior surface and wherein the second interconnectable component may make contact with and electrically and mechanically connect to the first interconnectable component at any point on the first interconnectable component; and a third interconnectable component having a housing wherein the third interconnectable component is entirely non-conductive and wherein the third interconnectable component is used to block the electrical current flow between the first or second interconnectable component and a fourth interconnectable component.

16. The quick connect electro-mechanical system of claim 15 wherein the first, second and third interconnectable components are of substantially identical size and shape.

17. The quick connect electro-mechanical system of claim 15 further comprising:

a snap-fitting mechanical connector system having a male and female component wherein the male snap-fitting mechanical connector component extends outward from a first interconnectable component and wherein the male snap-fitting mechanical connector component electrically and mechanically connects to the female snap-fitting mechanical connector located on a second interconnectable component.

* * * * *

UNITED STATES PATENT AND TRADEMARK OFFICE

CERTIFICATE OF CORRECTION

PATENT NO. : 8,221,182 B2
APPLICATION NO. : 12/639327
DATED : July 17, 2012
INVENTOR(S) : Arthur Seymour et al.

It is certified that error appears in the above-identified patent and that said Letters Patent is hereby corrected as shown below:

Title page, item [75] inventor: Gerald J. Ceuhin should read as follows: Gerald J. Cecchin.

Signed and Sealed this
Twenty-fifth Day of December, 2012

David J. Kappos
*Director of the United States Patent and Trademark Office*